US007134397B2

(12) United States Patent
Hutchinson et al.

(10) Patent No.: US 7,134,397 B2
(45) Date of Patent: Nov. 14, 2006

(54) SYSTEM FOR APPLYING VERTICAL COMPRESSIVE FORCE TO FURNACE WALLS

(75) Inventors: Kenneth T. Hutchinson, Mississauga (CA); Kenneth M. Donaldson, Toronto (CA); Keith E. Joiner, Burlington (CA); Clarence A. Nichols, Mississauga (CA); Jimmy Sarvinis, Brisbane (AT)

(73) Assignee: Hatch, Ltd., Mississauga (CA)

( * ) Notice: Subject to any disclaimer, the term of this patent is extended or adjusted under 35 U.S.C. 154(b) by 20 days.

(21) Appl. No.: 10/854,349

(22) Filed: May 26, 2004

(65) Prior Publication Data

US 2005/0263048 A1 Dec. 1, 2005

(51) Int. Cl.
*F23M 5/00* (2006.01)
*F27D 1/00* (2006.01)

(52) U.S. Cl. ..... 110/336; 432/251; 266/285

(58) Field of Classification Search ..... 110/336, 110/331, 332; 266/283, 285, 280, 286; 432/251, 432/247

See application file for complete search history.

(56) References Cited

U.S. PATENT DOCUMENTS

| | | | | |
|---|---|---|---|---|
| 1,448,060 | A | 3/1923 | Graham | |
| 2,101,786 | A | 12/1937 | Wise | |
| 2,182,674 | A * | 12/1939 | Morton | 432/248 |
| 2,622,433 | A | 12/1952 | Jones | |
| 2,656,717 | A | 10/1953 | Fourmanoit | |
| 2,840,364 | A | 6/1958 | Abbott et al. | |
| 2,975,499 | A | 3/1961 | Lapp | |
| 3,175,961 | A | 3/1965 | Olsen | |
| 3,197,385 | A | 7/1965 | Wethly | |
| 3,203,376 | A | 8/1965 | Engelhardt | |
| 3,682,457 | A | 8/1972 | Hollingsworth | |
| 3,869,996 | A | 3/1975 | Panferov et al. | |
| 4,240,234 | A | 12/1980 | Eisinger et al. | |
| 4,732,652 | A | 3/1988 | Dürselen et al. | |
| 6,286,442 | B1 | 9/2001 | Ranki | |
| 6,814,012 | B1 | 4/2004 | McCaffrey et al. | |

FOREIGN PATENT DOCUMENTS

| | | | |
|---|---|---|---|
| DE | 296546 A | * | 12/1991 |
| EP | 0 466 530 B1 | | 12/1995 |

OTHER PUBLICATIONS

Copy of PCT International Search Report mailed Aug. 22, 2005.

* cited by examiner

*Primary Examiner*—Kenneth Rinehart
(74) *Attorney, Agent, or Firm*—Kirkpatrick & Lockhart Nicholson Graham LLP

(57) ABSTRACT

A binding system for applying a vertical compressive force to the refractory walls of a rectangular or circular furnace comprises a compressive member engaging a laterally extending surface of the furnace wall and a support member to which the compressive member is connected. The compressive member preferably comprises a coil spring which acts directly on the laterally extending surface or indirectly through a force-applying member. The force applied by the compressive member is sufficient to control vertical expansion and substantially prevent vertical expansion of the furnace walls due to infiltration of material into the joints between the refractory bricks during operation of the furnace.

15 Claims, 4 Drawing Sheets

SYSTEM FOR APPLYING VERTICAL COMPRESSIVE FORCE TO FURNACE WALLS

FIELD OF THE INVENTION

The present invention relates to furnaces constructed of hearth and wall refractories, and more particularly relates to systems for the compressive binding of furnace wall refractories.

BACKGROUND OF THE INVENTION

Furnaces are used extensively in the smelting and converting of ferrous and non-ferrous ores and concentrates. Furnaces of this type are generally circular or rectangular, having a bottom wall (hearth), vertical walls comprised of refractory bricks and a roof or off-gas hood. Furnaces of this type are also characterized by a binding and support structure, the purpose of which is to maintain the refractory bricks of the hearth and walls in compression.

Adequate compression of the furnace walls, and particularly the hearth, is critical to maximize furnace campaign life and to prevent costly and potentially catastrophic furnace failure. During heating of the furnace to operating temperature, the individual bricks comprising the hearth and the walls expand, resulting in outward expansion of the hearth. Conversely, cooling of the furnace results in contraction of the individual bricks and overall shrinking of the furnace. If the compressive forces on the hearth or the walls are insufficient, gaps will be formed between the bricks during the cooling phase of the furnace operation. These gaps can be infiltrated with molten metal or other material, resulting in permanent growth of the furnace. Repetition of heating and cooling cycles results in further incremental expansion of the furnace (known as "ratcheting"), which usually results in a reduction of the furnace campaign life, by the potential for molten material infiltrating into the hearth refractory or excessive expansive forces exerted on the binding system.

Furnace binding systems are known for applying horizontally directed compressive forces on the walls and hearth of a furnace in order to control outward expansion of the furnace. Such binding systems are discussed in detail in the applicant's co-pending U.S. patent application Ser. No. 10/269,392, filed on Oct. 11, 2002.

The inventors have found that infiltration of materials into the joints between refractory bricks in a furnace wall can result in vertical expansion or "ratcheting" in the wall, which is also detrimental to furnace campaign life. At present, there are no furnace binding systems known to the inventors which are able to effectively control vertical expansion of the furnace walls.

SUMMARY OF THE INVENTION

The present invention overcomes the above-described problems of the prior art by providing a binding system for controlling vertical expansion of a furnace wall. The binding system according to the invention comprises a compressive member which engages a laterally extending surface in an upper portion of the furnace wall. The compressive member applies downwardly directed compressive force on the wall to prevent infiltration of molten metal or other material into the gaps between the bricks making up the wall. The system also comprises a support member which is located close to the furnace for supporting the compressive member.

In one aspect, the present invention provides a vertical furnace binding system for controlling vertical expansion of a vertically-extending wall of a furnace. The furnace wall has a laterally extending surface in an upper portion thereof and is constructed of refractory bricks arranged in stacked relation to one another. The binding system comprises: (a) a compressive member engaging the laterally extending surface so as to apply a downwardly directed compressive force on the wall, the force being applied through the laterally extending surface; and (b) a support member proximate the furnace to which the compressive member is connected. The force applied by the compressive member is sufficient to control vertical expansion of the wall and substantially prevent vertical expansion of the wall due to infiltration of material into joints between the refractory bricks during operation of the furnace.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
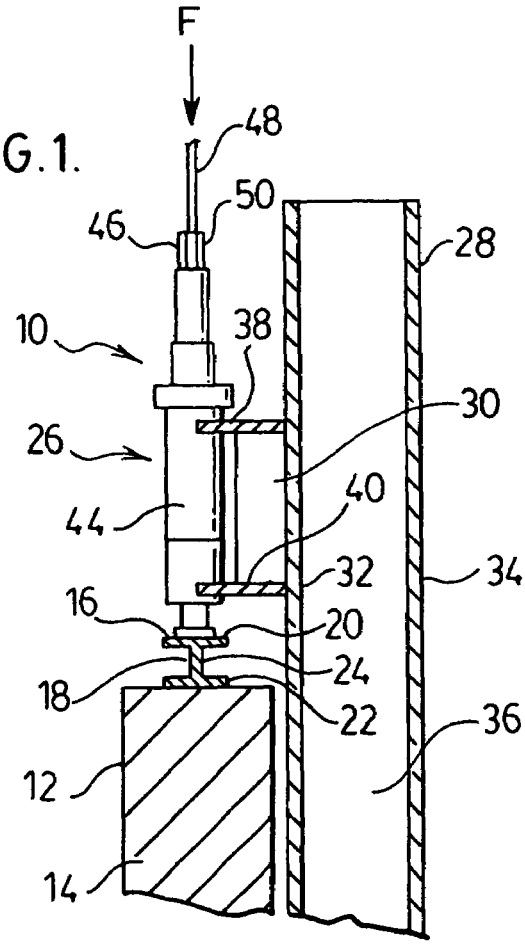
FIG. 1 is a side view, partly in cross section, showing a vertical furnace binding system according to a first preferred embodiment of the invention.
Figure 2:
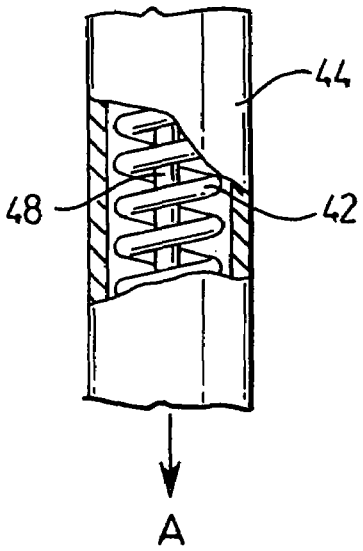
FIG. 2 is a close-up, cut away side view of the housing of a compressive member forming part of the vertical binding system of claim 1.

FIGS. 1 and 2 illustrate a furnace binding system 10 according to a first preferred embodiment for applying a vertically downwardly directed compressive force on a furnace wall 12. The wall 12 is constructed of refractory bricks 14 (individual bricks not shown) arranged in stacked relation to one another. The wall 12 has a laterally extending surface 16 in an upper portion thereof. The laterally extending surface 16 in FIG. 1 is located at the top of wall 12 and comprises an upper surface of a horizontally extending pressure beam 18 supported on top of the refractory portion of wall 12. The pressure beam 18 comprises an elongate structural member which, in FIG. 1 comprises an I-beam having a pair of flanges 20, 22 connected by a web portion 24. It will be appreciated that the pressure beam can have any desired cross section, for example it may have a square or rectangular cross-section.

The binding systems described herein may be applied to rectangular or circular furnaces. Unless otherwise indicated, the terms "wall" and "furnace wall" as used herein include side walls and end walls of a rectangular furnace and the cylindrical sidewall of a circular furnace. Where the furnace is rectangular, it will be appreciated that a binding system is preferably provided for each side and end wall.

The term "laterally extending surface" as used herein is intended to include any portion of a furnace wall through which a downwardly directed compressive force can be transmitted to the refractory bricks making up the wall. The laterally extending surface may be horizontal as shown in FIG. 1 or may be acutely angled relative to the horizontal. Although a pressure beam 18 is not required in all circumstances, it is preferred in the embodiment shown in FIG. 1 as it evenly distributes the compressive forces generated by binding system 10 along the length of wall 12.

The binding system 10 is comprised of at least one compressive member 26. Each compressive member 26 engages the laterally extending surface 16 (the upper surface of flange 20) so as to apply a downwardly directed compressive force (parallel to arrow F in FIG. 1) on the wall 12, the force being applied through the laterally extending surface 16. Although FIG. 1 illustrates one compressive member 26, it will be appreciated that the binding system 10 preferably includes additional compressive members 26 regularly spaced along the length of wall 12, so as to apply an evenly distributed compressive force along substantially the entire length of wall 12. Furthermore, each wall of the furnace is preferably provided with a vertical binding system.

The binding system 10 also comprises at least one support member 28 located proximate the furnace, preferably adjacent to the wall 12, with each compressive member 26 being connected to a support member 28. In the first preferred binding system 10, each of the support members 28 comprises a vertically extending beam, for example a buckstay, and each of the compressive members 26 along wall 12 is connected to a single support member 28 by a support bracket 30. In the preferred embodiment shown in the drawings, the support member 28 comprises a buckstay which is in the form of an I-beam and comprises a pair of flanges 32, 34 and a connecting web portion 36. The support bracket 30 is attached to the flange 32 facing the furnace wall 12 and comprises a pair of arms 38, 40 which support the compressive member 28.

As shown in FIG. 2, the compressive members 26 each comprise a coil spring 42, a cylindrical housing 44 in which the spring 42 is contained, and a compression assembly 46 protruding from the top of housing 44. The spring 42 is mounted such that its axis A extends vertically through the wall 12. Therefore, in binding system 10, the compressive force generated by springs 42 is directly applied to the furnace wall 12.

The compression assembly 46 comprises a threaded compression assembly shaft 48, the lower end of which extends into the housing 44 and engages the top of the spring 42, and a compression nut 50 threaded onto the shaft 48. The compressive force applied to the wall 12 by spring 42 can be adjusted by turning the compression nut 50 with a wrench (not shown), thereby moving the shaft 48 upwardly to decrease the compression of spring 42 or downwardly to increase the compression of spring 42. Alternatively, adjustment of the compression assembly 46 may involve application of a hydraulic device (not shown) to the compression assembly shaft 48, adjustment of the spring pressure using the hydraulic device, and then re-tightening of the compression nut 50.

The compressive force applied to the wall 12 by the compressive members 26 is sufficient to substantially prevent vertical expansion of the wall 12 caused by infiltration of material into joints between the refractory bricks during operation of the furnace.

It will be appreciated that there are two causes of vertical expansion of furnace walls. The first is vertical expansion which occurs during heating of the furnace to its operating temperature. This type of vertical expansion is caused by expansion of the individual refractory bricks as they are heated, and is reversible since the bricks will contract to their original dimensions when the furnace is cooled. The second type of vertical expansion is that referred to above, which is caused by infiltration of molten metal into the joints between the refractory bricks. This type of vertical expansion, also known as "ratcheting", is not reversible. The binding system according to the invention prevents the second type of vertical expansion caused by infiltration of material into the joints between refractory bricks, and does not substantially prevent vertical expansion caused by expansion of the bricks. Thus, when it is stated herein that the inventive binding systems prevent vertical expansion of furnace walls, this is intended to mean that the binding systems substantially prevent irreversible vertical expansion due to ratcheting.

It may be preferred to provide a pair of compressive members 26 at each of the support members 28, although the provision of only one compressive member at some or all of the support members 28 may be sufficient. When the compressive members 26 are paired, each member 26 of a pair is preferably arranged on either side of the support member 28.

Figure 3:
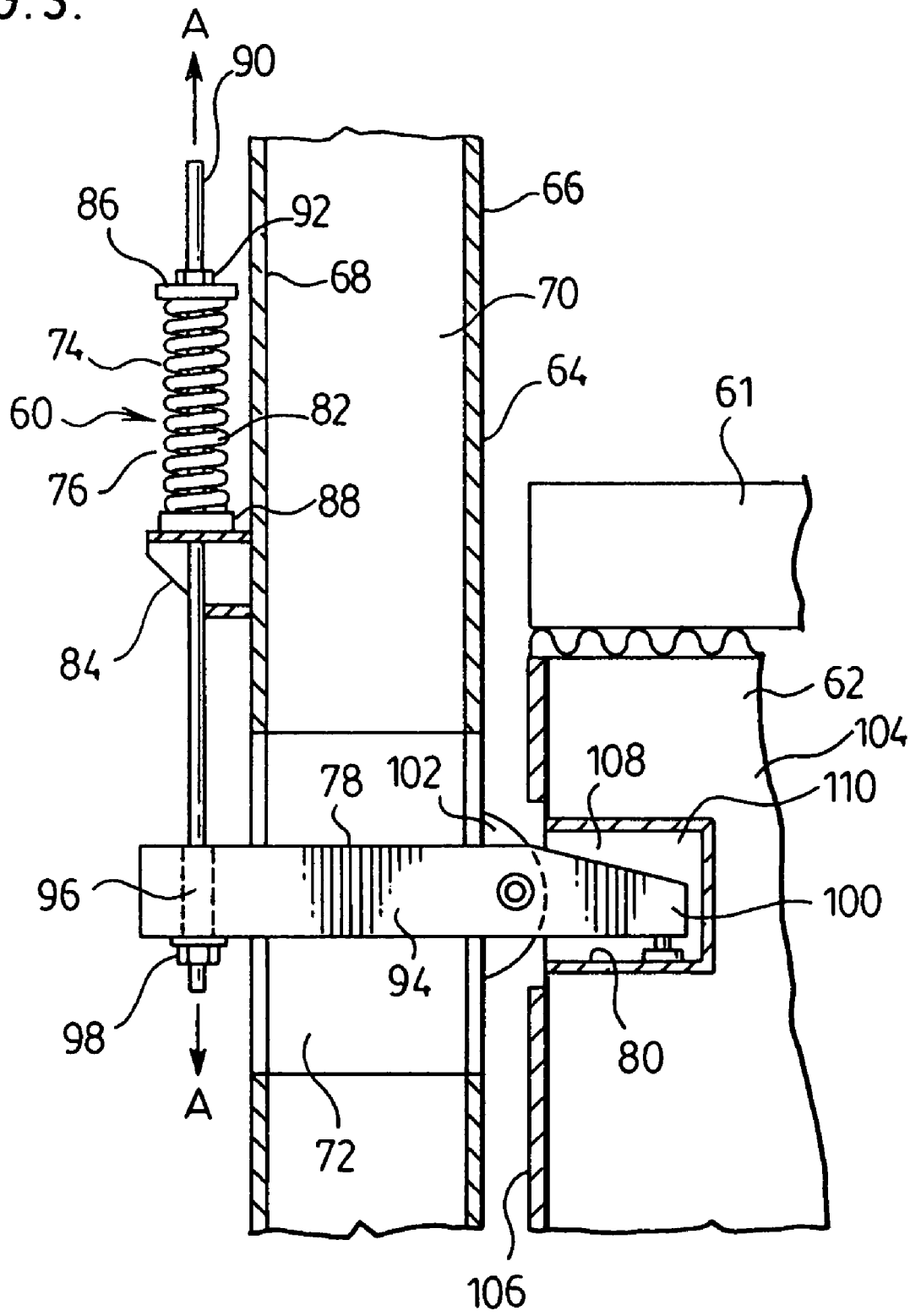
FIG. 3 is a side view, partly in cross section, showing a vertical furnace binding system according to a second preferred embodiment of the present invention.

FIG. 3 illustrates a furnace binding system 60 according to a second preferred embodiment of the invention for applying a vertical compressive force to a furnace wall 62. The second preferred binding system 60 is adapted for use in furnaces where the furnace roof 61 extends over the furnace wall 62, thereby precluding use of the binding system of the first preferred embodiment of the invention. The binding system 60 according to the second preferred embodiment is secured to a buckstay 64 which comprises an I-beam having a front flange 66 facing the furnace wall 62, an opposed rear flange 68 and a connecting web portion 70. The buckstay 64 is provided with an aperture 72 extending from the rear flange 68 to the front flange 66 through which the binding system 60 extends. Thus, the compressive force applied by the binding system 60 is directly in line with the buckstay 64, avoiding uneven distribution of the compressive forces.

As in the first preferred embodiment, the binding system 60 comprises a compressive member 74 and a support member which, in this preferred embodiment, comprises the buckstay 64. The binding system 60 differs from that of the first preferred embodiment in that the compressive member 74 comprises a separate force-generating member 76 which generates the compressive force, and a force-applying member 78 through which the vertical compressive force is applied to a laterally extending surface 80 of the wall 62.

As in the first preferred embodiment, the force generating member 76 of compressive member 74 comprises a coil spring 82 having a vertically aligned axis A. However, in this preferred embodiment, the spring 82 is mounted on a support bracket 84 extending from the rear flange 68 of buckstay 64 so that the axis A of spring 82 extends along the rear flange 68 of the buckstay 64, rather than through the furnace wall 62. The coil spring 82 is compressed between an upper spring mount 86 and a lower spring mount 88 which is supported on the upper face of bracket 84. A spring rod 90 extends vertically through the spring 82, the spring mounts 86 and 88, and through the support bracket 84. The upper end of spring rod 90 is threaded and protrudes through the upper spring mount 86. A compression nut 92 is threaded onto the upper end of rod 90 and engages the upper spring mount 86. The compression of spring 82 is adjusted as described above in relation to the first preferred embodiment, for example by turning the nut 92 with a wrench or by use of a hydraulic device. It will be appreciated that the spring 82, when compressed, exerts an upwardly directed force on the upper spring mount 86 and the compression nut 92 on its upper surface, thereby biasing the spring rod 90 upwardly.

As shown in FIG. 3, the lower end of spring rod 90 extends downwardly through bracket 84 and is connected to the force applying member 78. The force applying member 78 comprises a hold-down arm 94 having a first end 96 which protrudes through the rear flange 68 of buckstay 64 and is pivotably connected to the lower end of the spring rod 90. In the example shown in FIG. 3, a nut 98 is threaded onto the lower end of rod 90 to connect the rod 90 and the hold-down arm 94. The second end 100 of hold down arm 94 engages the laterally extending surface 80 of the wall 62. The hold down arm 94 is pivotably connected to a pivot bracket 102 provided on the front flange 66 of buckstay 64, such that upward biasing of the first end 96 of hold down arm 94 by spring rod 90 causes downward biasing of the second end 100 on the laterally extending surface 80, thereby resulting in vertical compression of the wall 62.

In the second preferred embodiment, the furnace wall 62 is comprised of refractory brick 104 with a metal structural shell 106. As shown in FIG. 3, the metal shell 106 has an inwardly extending channel 108 which defines a recess 110 in the furnace wall 62, with the second end 100 of the hold down arm 94 extending into this recess 110. In this embodiment, the laterally extending surface 80 comprises the bottom wall of the inwardly extending portion 108. Although the laterally extending surface 80 is provided in an upper portion of the furnace wall 62, it is not provided on the top thereof. This arrangement is particularly useful where direct access to the upper surface of the furnace wall 62 is not available, as for example where a roof 61 is provided over the furnace and extends over the tops of the furnace walls. It will be appreciated that the metal shell 106 does not necessarily extend into the recess 110 in the furnace wall 62. Rather, the second end 100 of the hold down arm 94 may be in direct contact with refractory brick inside recess 110.

It will be appreciated that arrangements other than that shown in FIG. 3 may be provided for indirectly applying a compressive force to a furnace wall. For example, rather than providing a single compressive member 74 extending through an aperture 72 in the buckstay 64, it may be preferred to attach the compressive members to the sides of the buckstays, preferably in pairs, with the force-applying members extending along the web portions of the buckstays. This type of arrangement is preferably used along the walls and/or end walls of a furnace.

Figure 4:
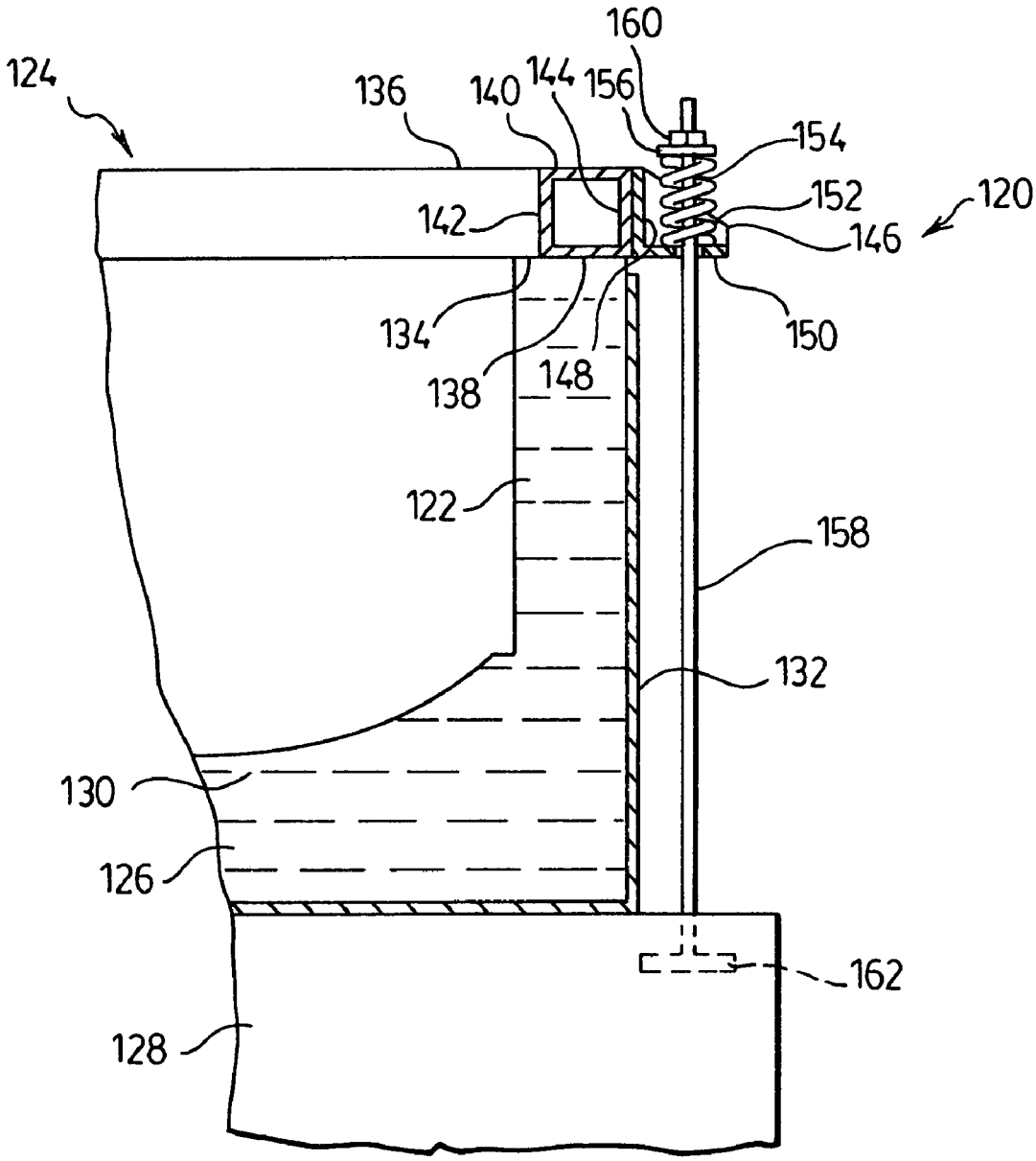
FIG. 4 is a side view, partly in cross section, showing a vertical furnace binding system according to a third preferred embodiment of the present invention.

FIG. 4 illustrates a binding system 120 according to a third preferred embodiment of the present invention which is preferably used for vertical compression of the cylindrical side wall 122 of a circular furnace 124. The circular furnace 124 further comprises a hearth 126 and is supported on a foundation 128. Both the side wall 122 and the hearth 126 are formed from refractory bricks and the exterior of the sidewall is preferably provided with a metal structural shell 132. The side wall 122 has an upper surface 134 on which is provided a circumferentially-extending ring beam 136. As shown in FIG. 4, the ring beam 136 may preferably have a square or rectangular cross-section, having a lower face 138 contacting the upper surface 134 of the side wall 122, an opposed upper face 140, an inner face 142 and an opposed outer face 144.

Secured to the outer face of the ring beam 136 at regularly spaced intervals are a plurality of support brackets 146, only one of which is shown in FIG. 4. The support bracket 146 has a rear wall 148 attached to the ring beam 136, a bottom wall 150 extending outwardly from the rear wall 148 and a pair of side walls 152 (only one of which is visible in FIG. 4) connected to the edges of both the rear wall 148 and the bottom wall 150. The bottom wall 150 of bracket 146 forms the laterally extending surface of the furnace side wall 122 and supports a coil spring 154 which is compressed between the bottom wall 150 and an upper spring mount 156. As in the second preferred embodiment, a spring rod 158 extends vertically through the coil spring 154, the spring mount 156 and the bottom wall 150 of bracket 146. The upper end of rod 158 is threaded to receive a compression nut 160 which can be loosened and tightened to control compression of the spring 154. The rod 158 extends downwardly along the side wall 122 of the furnace 124 and is secured against vertical movement by anchoring it to the foundation 128. In the example shown in FIG. 4, the lower end of rod 158 is embedded in the foundation 128 and is provided with a horizontally-extending portion 162 to resist pull-out.

As will be appreciated from FIG. 4, the binding system 120 according to the third preferred embodiment does not utilize a buckstay as the support member. Rather, the support member in the third preferred embodiment comprises the ring beam 136.

Figure 5:
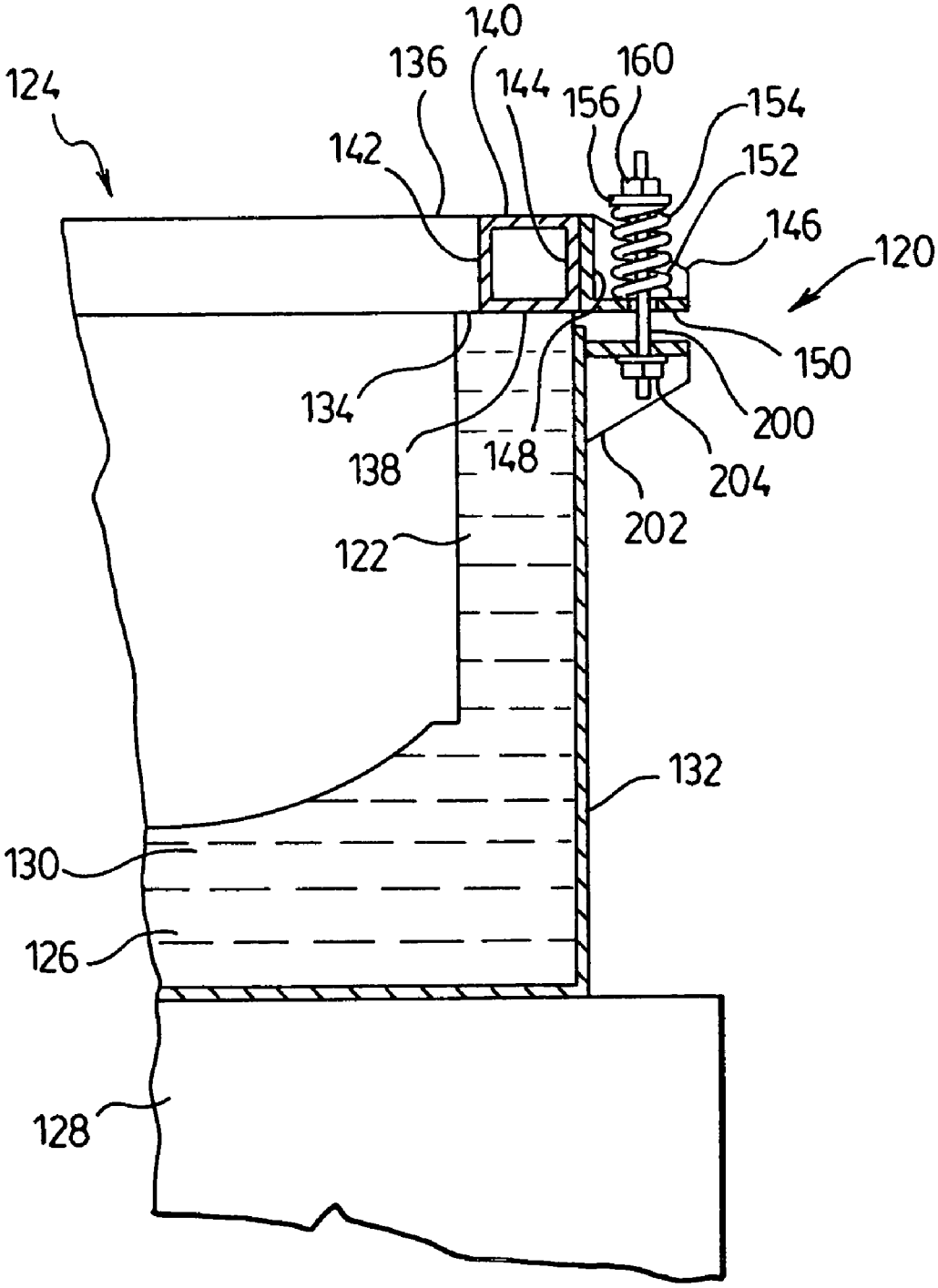
FIG. 5 is a side view, partly in cross section, showing a vertical furnace binding system according to a fourth preferred embodiment of the present invention.

FIG. 5 illustrates a furnace binding system 170 according to a fourth preferred embodiment of the invention for applying a vertical compressive force to a furnace sidewall 122. This embodiment is similar to that shown in FIG. 4 and like reference numerals are used to identify like features of this embodiment. The embodiment of FIG. 5 differs in that the bottom end of spring rod 200 is not anchored to the foundation 128. Rather, the spring rod 200 is anchored by a bracket 202 attached to the structural metal shell 132 and is held in place on the bracket 202 by a nut 204.

Although the invention has been described in connection with certain preferred embodiments, it is not limited thereto. Rather, the invention is intended to include all embodiments which may fall within the scope of the following claims.

What is claimed is:

1. A vertical furnace binding system for controlling vertical expansion of a vertically-extending wall of a furnace, the wall having a laterally extending surface in an upper portion thereof and being constructed of refractory bricks arranged in stacked relation to one another, the system comprising:

(a) a plurality of compressive members, each of said compressive members engaging the laterally extending surface so as to apply a downwardly directed compressive force on the wall, the force being applied through the laterally extending surface; and (b) a plurality of support members proximate the furnace, wherein each of the compressive members is connected to one of said support members;

wherein the force applied by the compressive member is sufficient to control vertical expansion of the wall and substantially prevent vertical expansion of the wall due to infiltration of material into joints between the refractory bricks during operation of the furnace;

wherein the laterally extending surface comprises a metal beam which is supported on top of the wall and extends continuously along a length of the wall, each of the compressive members engaging said metal beam; and wherein the compressive members are spaced regularly along the length of the wall so as to apply an evenly distributed compressive force along substantially the entire length of the wall.

2. The vertical furnace binding system of claim 1, wherein the support member comprises a vertical beam extending along an outer surface of the wall.

3. The vertical furnace binding system of claim 2, wherein the vertical beam is a buckstay.

4. The vertical furnace binding system of claim 1, wherein the compressive member comprises one or more force-generating members for generating the compressive force, the force-generating members being selected from the group consisting of springs and fluid-pressurized cylinders.

5. The vertical furnace binding system of claim 4, wherein each of the force-generating members generates a substantially vertically directed force.

6. The vertical furnace binding system of claim 4, further comprising adjustment means for varying the compressive force generated by the force-generating member.

7. The vertical furnace binding system of claim 6, wherein the force-generating member comprises a coil spring, and wherein the adjustment means comprises means for changing a length of the spring.

8. The vertical furnace binding system according to claim 1, wherein the furnace is a rectangular furnace comprising four of said vertically-extending walls.

9. A vertical furnace binding system for controlling vertical expansion of a vertically-extending wall of a furnace, the wall having a laterally extending surface in an upper portion thereof and being constructed of refractory bricks arranged in stacked relation to one another, the system comprising:

(a) a compressive member engaging the laterally extending surface so as to apply a downwardly directed compressive force on the wall, the force being applied directly to the wall through the laterally extending surface; and (b) a support member proximate the furnace to which the compressive member is connected;

wherein the force applied by the compressive member is sufficient to control vertical expansion of the wall and substantially prevent vertical expansion of the wall due to infiltration of material into joints between the refractory bricks during operation of the furnace;

wherein the furnace comprises one or more of said vertically-extending side walls and wherein said one or more walls form a square, rectangle or cylinder having an upper peripheral surface on which a continuous beam is provided, the beam extending along the entire peripheral surface and comprising the support member to which the compressive member is connected.

10. The vertical furnace binding system according to claim 9, wherein the compressive member comprises a coil spring which is supported on a bracket, the bracket being connected to the continuous beam and extending radially outwardly from the continuous beam, the bracket having a surface on which the coil spring is supported and which comprises the laterally extending surface of the wall.

11. The vertical furnace binding system according to claim 10, wherein the compressive member further comprises a rod having an upper end extending through an upper end of the spring and applying a compressive force to the spring through a compression nut.

12. The vertical furnace binding system according to claim 11, wherein the furnace is supported on a base and wherein the rod extends downwardly along an outer surface of the wall and has a lower end which is secured to the base.

13. The vertical furnace binding system according to claim 12, wherein the lower end of the rod is embedded in the base.

14. The vertical furnace binding system according to claim 11, wherein the rod extends downwardly along an outer surface of the wall and has a lower end which is secured to a bracket attached to an outer shell of the furnace wall.

15. The vertical furnace binding system according to claim 9, wherein the furnace comprises a circular furnace, said one or more vertically-extending walls comprises a cylindrical side wall and said continuous beam comprises a circumferentially-extending ring beam.

* * * * *

UNITED STATES PATENT AND TRADEMARK OFFICE

CERTIFICATE OF CORRECTION

PATENT NO. : 7,134,397 B2
APPLICATION NO. : 10/854349
DATED : November 14, 2006
INVENTOR(S) : Kenneth T. Hutchinson et al.

It is certified that error appears in the above-identified patent and that said Letters Patent is hereby corrected as shown below:

Column 6, line 50, insert --directly to the wall-- before “through”

Signed and Sealed this

Thirteenth Day of November, 2007

JON W. DUDAS
*Director of the United States Patent and Trademark Office*